United States Patent [19]

Ordonez

[11] 4,006,763

[45] Feb. 8, 1977

[54] IMPACT REACTION HAMMER

[75] Inventor: Emil Ordonez, Las Vegas, Nev.

[73] Assignee: The Raymond Lee Organization, Inc., New York, N.Y. ; a part interest

[22] Filed: Oct. 3, 1975

[21] Appl. No.: 619,402

[52] U.S. Cl. ..... 145/29 R; 145/29 A; 145/30.5

[51] Int. Cl.[2] ..... B25C 1/00; B25D 1/00

[58] Field of Search ..... 145/29 R, 29 A, 30.5, 145/29 B, 36

[56] References Cited

UNITED STATES PATENTS

| | | | |
|---|---|---|---|
| 492,608 | 2/1893 | Kratz | 145/30.5 |
| 530,761 | 12/1894 | Friedlander | 145/29 R |
| 1,449,136 | 3/1923 | Yates | 30/367 |
| 1,461,032 | 7/1923 | Forsyth | 30/367 |
| 2,010,575 | 8/1935 | White | 145/30.5 |
| 2,451,217 | 10/1948 | Heinrich | 145/29 B |
| 2,763,172 | 9/1956 | Richards | 145/29 A |
| 2,776,689 | 1/1957 | Falzone | 145/29 A |
| 3,172,438 | 3/1965 | Gianelli | 145/29 B |
| 3,568,657 | 3/1971 | Gue | 145/30.5 |
| 3,605,832 | 9/1971 | Stephens | 145/29 B |

FOREIGN PATENTS OR APPLICATIONS

| | | | |
|---|---|---|---|
| 1,163,525 | 4/1958 | France | 145/36 |

*Primary Examiner*—Al Lawrence Smith
*Assistant Examiner*—J. T. Zatarga
*Attorney, Agent, or Firm*—Howard I. Podell

[57] ABSTRACT

A hammer, the head of which is fitted with a slidable ballast member for adding impact force to the hammer head in use. The hammer head is threadably mounted to a shank about which a weighted ring is slidably mounted.

2 Claims, 3 Drawing Figures

IMPACT REACTION HAMMER

SUMMARY OF THE INVENTION

My invention is a hammer, the head of which is fitted with a slidable ballast member for adding impact force to the hammer head in use. The hammer head is threadably mounted to a shank about which a weighted ring is slidably mounted.

By use of my invention, the manual effort of using a hammer is lessened with the slidable ballast furnishing impact force against the hammer head to drive the hammered work.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
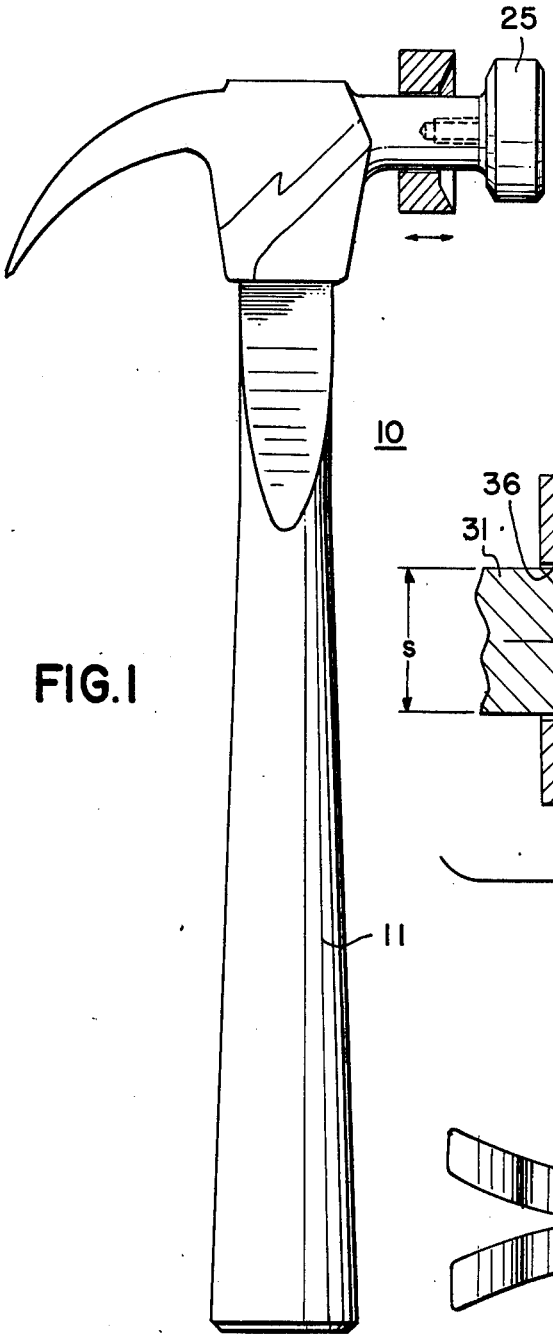
FIG. 1 is an elevation view of the invention.
Figure 2:
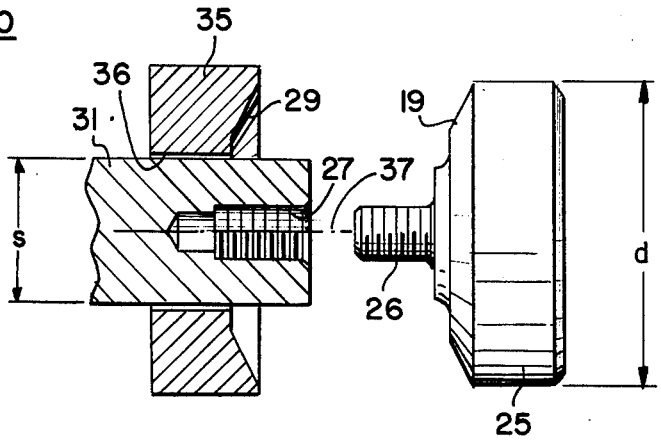
FIG. 2 is a fragmentary side view of the hammer head and shank.
Figure 3:
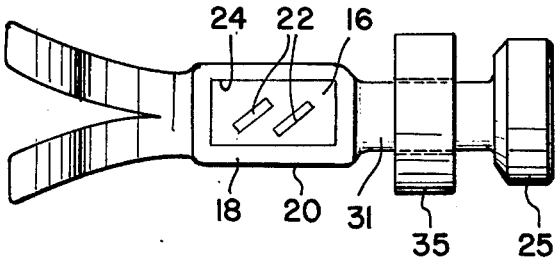
FIG. 3 is a plan view of the invention.

Turning now descriptively to the drawings, in which similar reference characters denote similar elements throughout the several views, FIGS. 1–3 illustrate the Reaction Hammer 10 which is fitted with a handle 11 conventionally fastened to the hammer head 20 by stakes 22 which expand the handle shank 16 inside the recess 24 of the hammer head 20.

Hammer head 20 is fitted with a removable driver head knob 25 which is fixed by a male threaded section 26 projecting from knob 25. Section 26 mates with a female thread 27 formed in cylindrical shank section 31 of the hammer head 20. The outer diameter *d* of knob 25 is of greater magnitude than the diameter *s* so that knob 25 projects transversely from the exterior surface 33 of shank 31 in all radial directions from the axis 37 of shank 3l.

A ballast 35, formed with a concentric through hole 36 of larger diameter than shank diameter *s*, is mounted about shank 31 between the central portion 18 of hammer head 20 and knob 25 so as to slide freely on shank 31 and to be able to strike knob 25 when slid towards knob 25.

Ballast 35 may be formed with a recessed opening 29 shaped to matingly engage a shaped rim 19 on the inside end of knob 25.

In use, the act of swinging the hammer 20 towards the work to be hammered causes the ballast 35 to slide away from knob 25, with ballast 35 sliding to, and striking knob 25 after knob 25 has hit the object being hammered. The blow of ballast 35 against knob 25 creates additional hammering force of knob 25, after the initial impact of knob 25 with the hammered work.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. An improved hammer for manual use, comprising a hammer head fastened to a handle, said hammer head formed with a cylindrical shank section projecting from the juncture of the hammer head and attached handle, and with said shank section extending along an axis generally perpendicular to the axis of the handle, with a knob detachably fastened to an end of the said shank section, said knob being of a generally cylindrical shape, with the sectional diameter of the external cylindrical surface of the knob being greater than the sectional diameter of the external cylindrical surface of the said shank section, together with a weighted closed ring loosely fitted about said shank section, said ring formed with a circular hole of greater diameter than the said sectional diameter of the shank section and of lesser diameter than the said sectional diameter of the knob, such that said shank section passes freely through said hole, said ring being of a lesser width than the length of said shank section so that the ring may freely slide along the length of said shank section to strike said knob when the hammer, in use, in swung by the handle to cause the knob to impact against an object, said closed ring being removable from said shank section when the shank section is detached from the knob.

2. The combination as recited in claim 1 in which the section of the knob that projects laterally beyond the shank section is formed with a first shaped concentric tapered face, adjacent the shank section, and the face of the ring which strikes the said knob section is formed with a second shaped concentric tapered face, said first and second concentric tapered faces being of complementary shape so that the ring will sit in concentric alignment relative to the knob when brought into abutting engagement with the knob by impact of the hammer head.

* * * * *